US008424994B2

(12) United States Patent
Otoshi

(10) Patent No.: US 8,424,994 B2
(45) Date of Patent: Apr. 23, 2013

(54) PRINTER, CONTROL METHOD THEREOF, AND STORAGE MEDIUM

(75) Inventor: Tatsuya Otoshi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 118 days.

(21) Appl. No.: 13/187,316

(22) Filed: Jul. 20, 2011

(65) Prior Publication Data

US 2012/0026232 A1 Feb. 2, 2012

(30) Foreign Application Priority Data

Jul. 28, 2010 (JP) ..... 2010-169511

(51) Int. Cl.
*B41J 29/38* (2006.01)

(52) U.S. Cl.
USPC ..... 347/16; 347/14; 347/214; 347/177

(58) Field of Classification Search ..... 347/14, 347/16, 19, 101, 104–107, 176, 177, 187, 347/188, 193, 213, 214, 221
See application file for complete search history.

(56) References Cited

U.S. PATENT DOCUMENTS 4,616,236 A * 10/1986 Watanabe et al. ..... 347/177
7,367,727 B2 * 5/2008 Hayashi ..... 347/214

FOREIGN PATENT DOCUMENTS

JP 2004-082610 A 3/2004
JP 2006-315215 A 11/2006

* cited by examiner

*Primary Examiner* — Juanita D Jackson
(74) *Attorney, Agent, or Firm* — Canon USA, Inc. IP Division

(57) ABSTRACT

A printer may include a sheet conveyance unit, a sheet detection unit, an ink sheet conveyance unit, a search position detection unit, and a control unit both to execute a continuous print mode by using sets of ink portions, where each set of ink portions has ink portions of an ink sheet, and to print screens adjacent to each other. In a case where power for the printer is turned ON, the control unit conveys a sheet that has been pulled out from a sheet housing unit in a direction for returning the sheet into the housing unit using the sheet conveyance unit. In addition, the control unit calculates a leading-end detection conveyance amount until a leading end of the sheet is detected by the sheet detection unit, and determines a discharge amount of the sheet based on the leading-end detection conveyance amount.

9 Claims, 9 Drawing Sheets

PRINTER, CONTROL METHOD THEREOF, AND STORAGE MEDIUM

BACKGROUND OF THE INVENTION

1. Field of the Invention

The present invention relates to a printer capable of executing a continuous print mode by using an ink sheet in which a plurality of ink portions are arranged in order in a conveyance direction, a control method thereof, and a storage medium.

2. Description of the Related Art

Many printers capable of printing image data captured by a digital steel camera, a digital video camera, or a mobile phone, have been placed on the market. An example of a printing system employed by such a printer is a thermal transfer system.

In the printer of the thermal transfer system (hereinafter, thermal transfer printer), a plurality of heating elements arranged in a main scanning direction of a thermal head are selectively heated according to the image data. Ink of an ink sheet is melted by the heat to be transferred to a sheet having an ink receptive layer on its surface, thereby printing an image of one main scanning. In this case, an image for each main scanning is printed while conveying the sheet in a sub-scanning direction, and an image of a predetermined size is printed.

A sublimation thermal transfer printer among the thermal transfer printers converts the ink of the ink sheet from a solid substance to gas, and sticks the ink to the sheet to print the image. Such a thermal transfer printer can change a density of one pixel by controlling the amount of heat applied to the thermal head and the number of its driving times. Thus, the thermal transfer printer can express a smooth image with high gradation, and is often used in photo printing.

In an ink sheet illustrated in FIG. 9, ink portions (sublimation dyes) of yellow (Y) 801, magenta (M) 802, and cyan (C) 803 are frame-sequentially arranged to form an image on its base material in a longitudinal direction. At the end thereof, there is disposed an overcoat (OP) portion 804 that is a hot-melt ink portion to protect an image formation layer transferred to a sheet. Search position detection markers 805 are respectively arranged between the ink portions 801 and 802 of Y and M, between the ink portions 802 and 803 of M and C, and between the ink portion 803 of C and the OP portion 804.

FIG. 10 illustrates a printing example of an image using the ink sheet. When one image is formed by using such an ink sheet, the image is thermally transferred to a sheet by using the ink portions 801 to 804 of Y, M, C, and OP as a set. In an ink cartridge for housing the ink sheet, therefore, sets of ink sheets each including the ink portions of 801 to 804 of Y, M, C, and OP are arranged in a repetitive manner for a printable number.

Generally, a length of the sheet including the ink portions 801 to 804 of Y, M, C, and OP is set so that an image can be printed on a longitudinal size of a sheet of a printing target.

As discussed in Japanese Patent Application Laid-Open No. 2004-082610, in a thermal transfer printer that uses continuous paper as a sheet, in addition to a normal image, an image 910 of a panoramic (wide) size using the ink portions 801 to 804 of Y, M, C, and OP for a two-surface amount illustrated in FIG. 10, can be printed. An arrow A indicates a sheet conveyance direction during printing, and an arrow B indicates a sheet conveyance direction during feeding-back (sheet returning to a printing start position).

In FIG. 10, a right screen (first screen) 911 of the panoramic image 910 is formed by transferring sublimation or hot-melt ink of the Y, M, C, and OP portions 801, 802, 803, and 804 of the ink sheet of a first surface to the sheet. Similarly, a left screen (second screen) 912 of the panoramic image 910 is formed by transferring sublimation or hot-melt ink of the Y, M, C, and OP portions 801, 802, 803, and 804 of the ink sheet of a second surface to the sheet.

In the thermal transfer printer, for example, when the hot-melt ink of the OP portion is applied again by mistake on a printed sheet, the ink sheet sticks to the printed sheet, causing a jamming problem of the printed sheet or the ink sheet. Such a problem occurs when an electric power failure or a forcible termination occurs during printing and supplying of power is cut off, and printing is performed again from the sheet in the middle of printing after reactivation.

To prevent such a problem, processing of inspecting remaining sheets in a printer engine before printing to be executed immediately after activation, and discharging of the remaining sheets, if detected, is performed. In the thermal transfer printer that uses the continuous paper as the sheet, processing of detecting a size of the ink sheet by an ink sheet cartridge, thereby cutting the sheet by a specific sub-scanning length to discharge the sheet, is performed.

In the thermal transfer printer capable of executing the panoramic size print mode, to process remaining sheets, which surface of the ink sheet has been used to print an image on the remaining sheet should be determined. As one of such determination methods, a print state is recorded in a read-only memory (ROM) for each end of printing of one screen.

However, when state recording fails due to an electric power failure or a forcible termination, not only writing of a print state may fail but also ROM data containing activation information may be destroyed, directly leading to a printer failure.

To surely prevent sticking of the ink sheet to the sheet caused by reprinting in a printed area, the printer is only required to cut the sheet by a printable maximum length, and then discharge the sheet. In this case, however, even unprinted sheets may be cut, causing a problem of sheet wastes.

Japanese Patent Application Laid-Open No. 2006-315215 discusses a technique of preventing reprinting on a printed sheet by using a sensor for detecting color changes of printing paper having a heat-sensitive sheet material to be changed in color by thermal energy and stuck to an unprinted area, and a heat-sensitive sheet. However, sticking the heat-sensitive sheet material to the printing paper causes a problem of a cost increase for the printing paper.

SUMMARY OF THE INVENTION

The present invention is directed to a printer and a control method thereof capable of preventing sticking of an ink sheet to a printed sheet caused by reprinting while avoiding a cost increase and sheet wastes.

According to an aspect of the present invention, a printer to execute a continuous print mode by using a plurality of sets of ink portions, wherein each set of ink portions has a plurality of ink portions of an ink sheet in which the plurality of ink portions are sequentially arranged in a conveyance direction, and to print a plurality of screens adjacent to each other, includes: a sheet conveyance unit configured to convey a sheet; a sheet detection unit configured to detect a leading end of a sheet; an ink sheet conveyance unit configured to convey the ink sheet; a search position detection unit configured to detect a search position of each ink portion of the ink sheet; and a control unit configured to convey, in a case where power for the printer is turned ON, a sheet that has been pulled out from a sheet housing unit in a direction for returning the sheet into the housing unit using the sheet conveyance unit, calculate a leading-end detection conveyance amount until a leading end of the sheet is detected by the sheet detection unit, and determine a discharge amount of the sheet based on the leading-end detection conveyance amount.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings. In general, there is provided a printer capable of executing a continuous print mode by using a plurality of sets of ink portions, the set of ink portions has a plurality ink portions of an ink sheet in which the plurality of ink portions are sequentially arranged in a conveyance direction, and printing a plurality of screens adjacent to each other to perform printing. When power is turned ON for the printer, as remaining sheet detection processing, a sheet is conveyed, and a leading-end detection conveyance amount k until a leading end of the sheet is detected by a sheet detection unit is calculated. A discharge amount of the sheet is determined based on the leading-end detection conveyance amount k.

Figure 1:
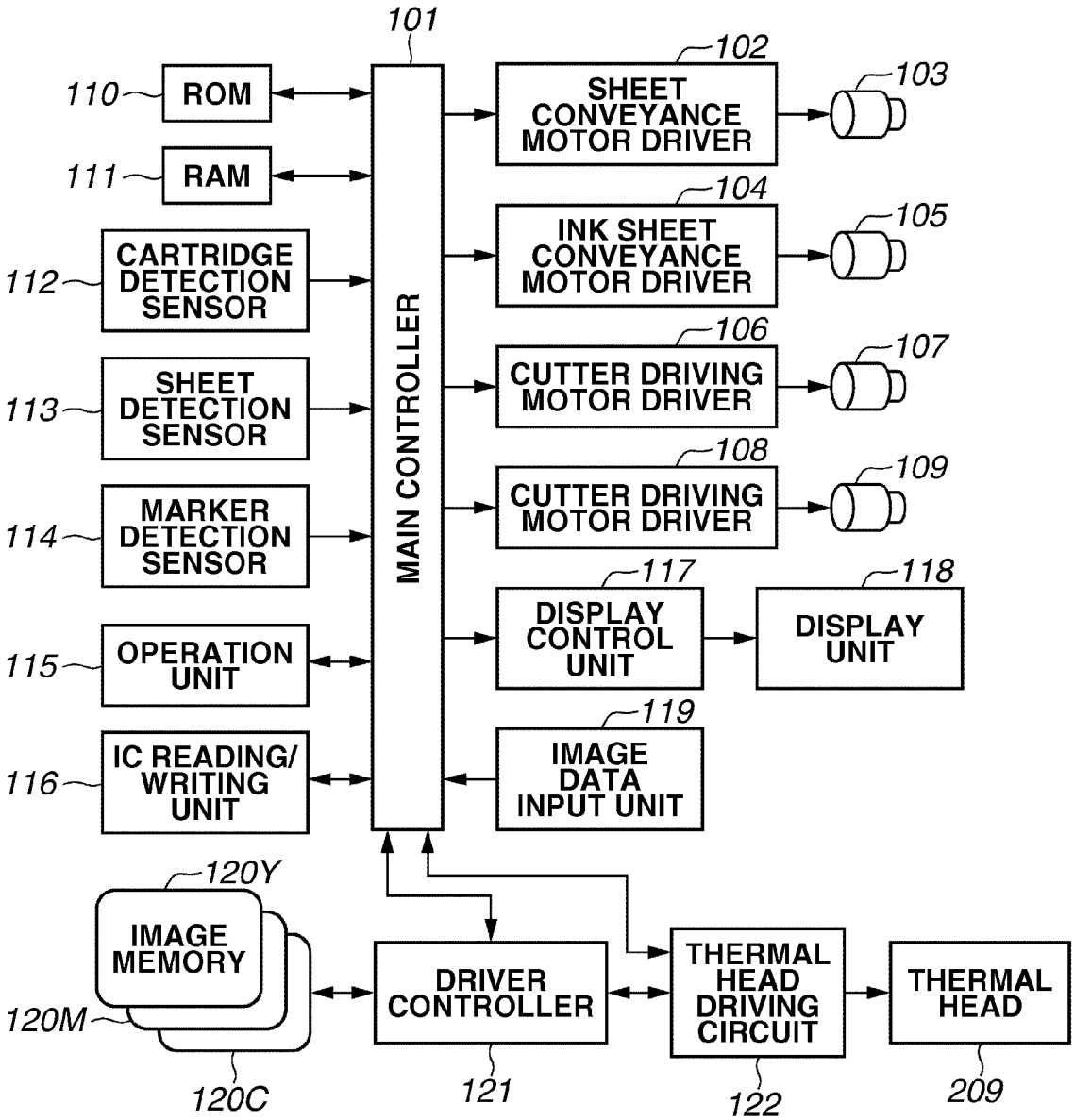
FIG. 1 is a block diagram illustrating a functional configuration of a thermal transfer printer according to an exemplary embodiment.

FIG. 1 is a block diagram illustrating a functional configuration of a thermal transfer printer according to an exemplary embodiment. The thermal transfer printer includes a main controller 101 responsible for overall control of the thermal transfer printer, a ROM 110, and a random access memory (RAM) 111. The main controller 101, which may include or be part of a central processing unit (CPU), controls the printer according to a control program stored in the ROM 111, and performs calculation according to various programs. The operation includes processing of image data, and generation of image data necessary for printing to be stored in the RAM 111.

The RAM 111 is also used as a work area of various control programs for temporary storage of image data and resizing of an image. The ROM 110 stores various control programs and various parameters such as an adjustment value.

The thermal transfer printer includes a sheet conveyance motor driver 102, and a sheet conveyance motor 103. The sheet conveyance motor driver 102 drives the sheet conveyance motor 103 under control of the main controller 101. The sheet conveyance motor 103 is coupled to a feed roller 202 (FIG. 2), a grip roller 203, and a discharge roller 207 described below via a rotational mechanism. A sheet 212 is conveyed by driving these rollers.

The thermal transfer printer includes an ink sheet conveyance motor driver 104, and an ink sheet conveyance motor 105. The ink sheet conveyance motor driver 104 drives the ink sheet conveyance motor 105 under the control of the main controller 101. The ink sheet conveyance motor 105 drives a roll bobbin 208 of an ink sheet take-up side described below via the rotational mechanism to take up an ink sheet 205.

The thermal transfer printer includes a thermal head elevation motor driver 106, and a thermal head elevation motor 107 for elevating a thermal head 209. Under the control of the main controller 101, the thermal head elevation motor driver 106 controls rotation of the thermal head elevation motor 107 to move the thermal head 209 between a printing position and a retracting position.

The thermal transfer printer includes a cutter driving motor driver 108, and a cutter motor 109 for driving a cutter 211. Under the control of the main controller 101, the cutter driving motor driver 108 controls the cutter motor 109 to cut the sheet 212.

The thermal transfer printer includes a sheet detection sensor 113 disposed between a platen roller 204 facing the thermal head 209 and the grip roller 203. The sheet detection sensor 113 detects passage of a leading end of the sheet 212 through a portion behind the grip roller 203 after its pulling-out from a cartridge (not illustrated) that stores the sheet.

Figure 9:
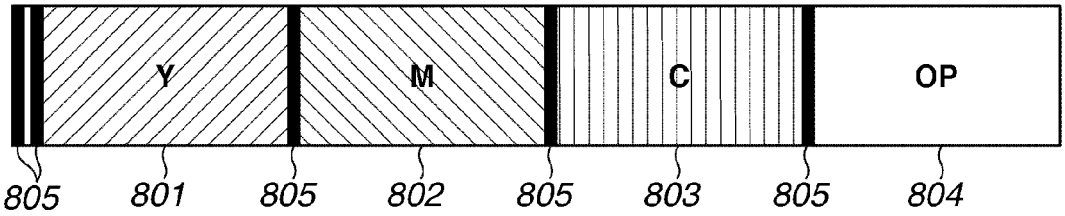
FIG. 9 illustrates an ink sheet for a thermal transfer printer.

An ink sheet marker detection sensor 114 detects markers 805 applied among ink portions 801 to 804 of Y, M, C, and OP of the ink sheet 205 illustrated in FIG. 9. A cartridge detection sensor 112 determines a cartridge loading state, and types of a plurality of cartridges. Based on a determination result, according to the control program stored in the ROM 110, printing is performed according to each cartridge.

The thermal transfer printer includes an operation unit 115 and an integrated circuit (IC) reading/writing unit 116. Image memories 120Y, 120M, and 120C record data obtained by converting image data to be printed, which has been input by an image data input unit 119, into printing data by the main controller. Printing data of yellow, magenta, and cyan are generated from the image data to be recorded in the image memories 120Y, 120M, and 120C.

A thermal head driving circuit 122 drives the thermal head 209. A controller 121 that controls driving of the thermal head driving circuit 122 performs control for driving the thermal head to print an image based on the printing data recorded in the image memories 120Y, 120M, and 120C.

Figure 2:
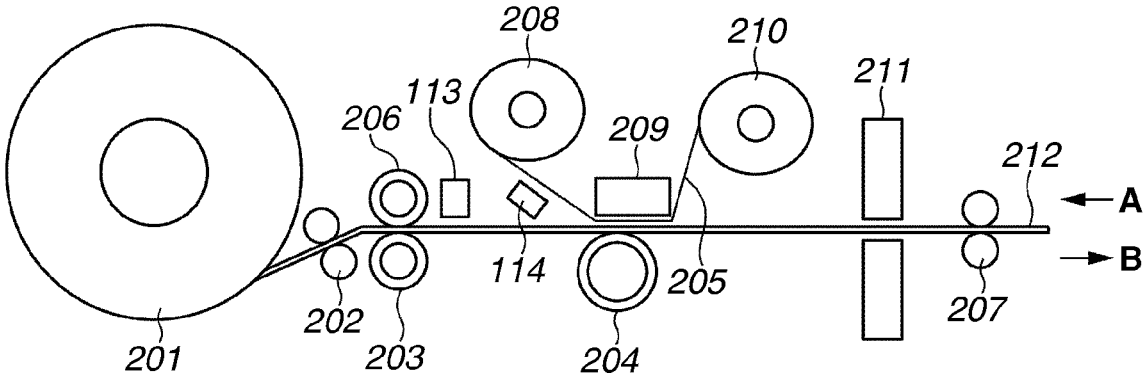
FIG. 2 schematically illustrates a configuration of a printer engine of the thermal transfer printer according to an exemplary embodiment.

FIG. 2 schematically illustrates a configuration of a printer engine of the thermal transfer printer according to the exemplary embodiment. A roll sheet 201 wound in a roll shape and housed in a cartridge is pulled out by rotating the feed roller 202. A leading end of a pulled-out sheet (recording medium) 212 is conveyed to the grip roller 203 driven by the rotation of a stepping motor.

A pinch roller 206 is located on an opposite side of the grip roller 203 to sandwich the sheet 212. The sheet 212 is conveyed to the sheet detection sensor 113 by rotating the grip roller 203. A photo reflector is used for the sheet detection sensor 113. After the sheet detection sensor 113 detects the leading end of the sheet 212, a conveyance position of the sheet 212 is controlled by an open loop.

By rotating the grip roller 203 more, the sheet 212 is conveyed to the platen roller 204 and the discharge roller 207. The thermal head 209 is located on an opposite side of the platen roller 204, and the ink sheet 205 passes between the thermal head 209 and the sheet 212.

The ink sheet 205 is configured by sequentially arranging in a conveyance direction, as described above referring to FIG. 9, ink portions (sublimation dyes) of yellow (Y) 801, magenta (M) 802, and cyan (C) 803, and an overcoat (OP) portion 804 that is a hot-melt ink portion. Sets each including such frame-sequentially arranged sublimation ink portions and a hot-melt ink portion are cyclically located.

Search position detection markers 805 are located between the sublimation ink portions and between the sublimation ink portion and the hot-melt ink portion. The markers 805 are detected by the marker detection sensor 114. A photo reflector is used for the marker detection sensor 114. The marker detection sensor 114 searches for the ink sheet 205 before or after printing of each color.

The ink sheet 205 is fed from a roll bobbin 210 of the ink sheet feeding side, and passes between the thermal head 209 and the sheet 212 to be taken up by the roll bobbin 208 of the ink sheet take-up side driven by rotation driving of the motor.

The thermal head 209 is a line-type thermal head that includes a plurality of heating elements arranged corresponding to at least a width (main scanning direction) of the sheet 212. The sheet 212 is conveyed in an A direction (sub-scanning direction) orthogonal to the thermal head 209, and an image is transferred (recorded) thereto.

To transfer the image to the sheet 212, the thermal head 209 and the platen roller 204 are in a press-contact state, and the ink sheet 205 is brought into contact with the heating elements of the thermal head 209 and the sheet 212. In this state, the main controller 101 drives the heating elements of the thermal head 209 to generate heat according to the image data. Through the driving of the heating elements to generate heat, the sublimation dyes of the sublimated ink sheet 205 are transferred to the receptive layer of the sheet 212 with which the ink sheet 205 has been pressed into contact by the platen roller 204, and fixed to form an image.

After the ink portions 801 to 803 of Y, M, and C have been transferred, the OP portion 804 is melted by the heat of the heating elements of the thermal head 209 to form a protective layer with which a surface of the color image of the transferred sheet is coated. When printing of one color image is thus ended, the sheet is conveyed in a B direction, and cut to a desired size by the cutter 211. The printed sheet is then discharged from the printer by rotating the discharge roller 207.

Figure 3:
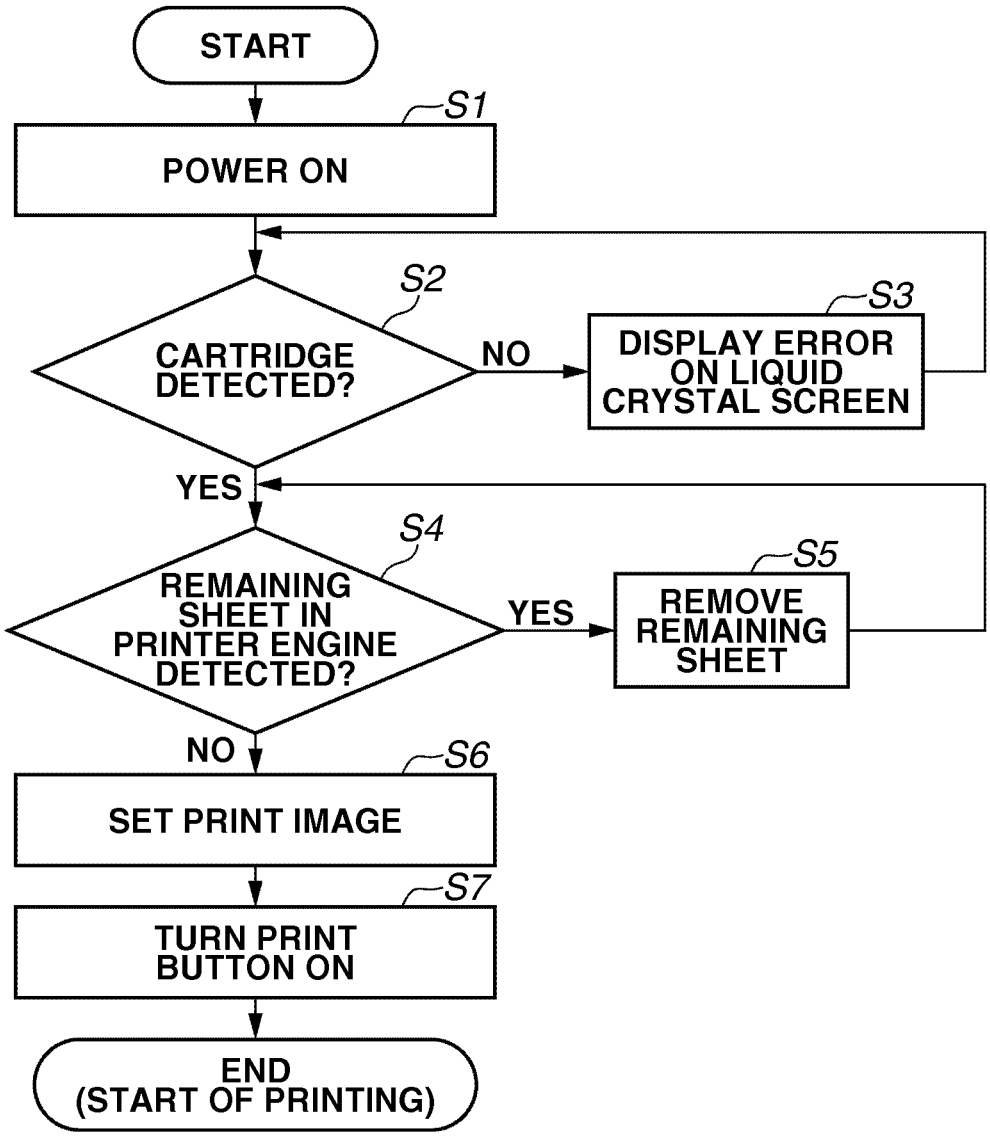
FIG. 3 is a flowchart illustrating a procedure when power for the thermal transfer printer is ON according to an exemplary embodiment.
Figure 4:
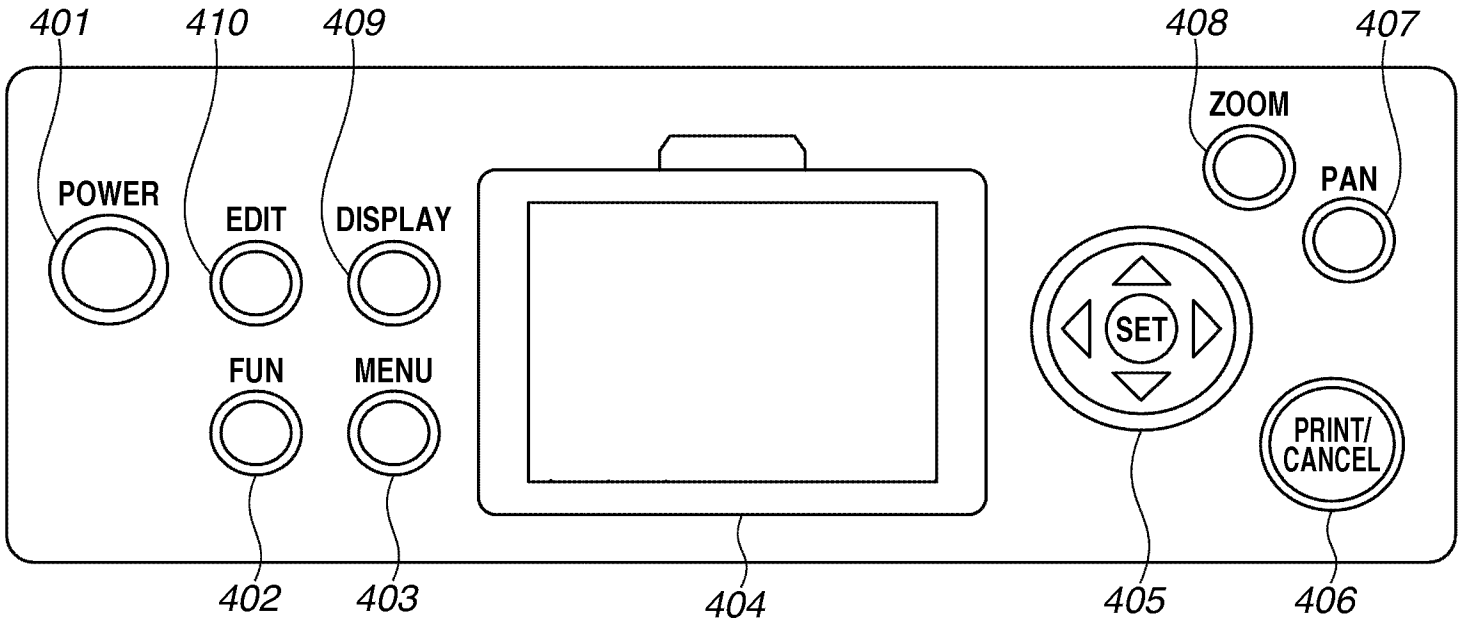
FIG. 4 is an external view illustrating an example of an operation unit of the thermal transfer printer according to an exemplary embodiment.

Next, referring to FIGS. 3 and 4, an operation from power-ON to a start of printing in the thermal transfer printer according to the exemplary embodiment, is described. FIG. 3 is a flowchart illustrating a procedure at the time of power-ON for the thermal transfer printer according to the present exemplary embodiment. FIG. 4 is an external view illustrating an example of the operation unit 115 of the thermal transfer printer according to the present exemplary embodiment.

As illustrated in FIG. 4, the operation unit 115 includes a power button 401 for power ON/OFF for the printer, a fun button 402, and a menu button 403. The operation unit 115 includes a liquid crystal screen 404 for displaying a graphical user interface (GUI) screen. The operation unit further includes a cross-key/SET button 405, a print/cancel button 406 for instructing execution/stoppage of printing, a pan button 407, a zoom button 408, a display button 409, and an edit button 410.

As illustrated in FIG. 3, first, in step S1, a user presses the power button 401 to turn power ON. In step S2, presence of a cartridge is determined by the cartridge detection sensor 112. When no cartridge is detected (NO in step S2), in step S3, a message for prompting the user to insert a cartridge is displayed on the liquid crystal screen 404.

When a cartridge is detected (YES in step S2), in step S4, presence of a sheet outside the cartridge in the printer engine (remaining sheet in the printer engine) is determined by the sheet detection sensor 113. When a remaining sheet is detected (YES in step S4), the processing proceeds to remaining sheet detection in step S5. The remaining sheet detection processing is described in detail below.

When no remaining sheet is detected (NO in step S4) (including a case where the processing returns to step S4 after appropriate completion of the remaining sheet detection in step S5), the processing proceeds to print image setting work in step S6.

In step S6, image data stored in a memory card is read, and an image is displayed on the liquid crystal screen 404. In this state, the user can select an image to be printed and set printing by using the cross-key/SET button 405. The user can change to a trimming edit screen of the image data, and determine a trimming size of the image by pressing the zoom button 408 or the pan button 407.

The user can display information such as a file name or a size of the designated image data by the display button 409. The user can change the screen, by pressing the fun button 402, to a selection screen of an edit function such as calendar creation, multilayout creation (arraying a plurality of image data to lay out), and panoramic image formation.

After selection of the image to be printed and various print setting operations are thud ended during the print image setting work in step S6, in step S7, the user presses the print/cancel button 406 to start printing by the thermal transfer printer.

Figure 5:
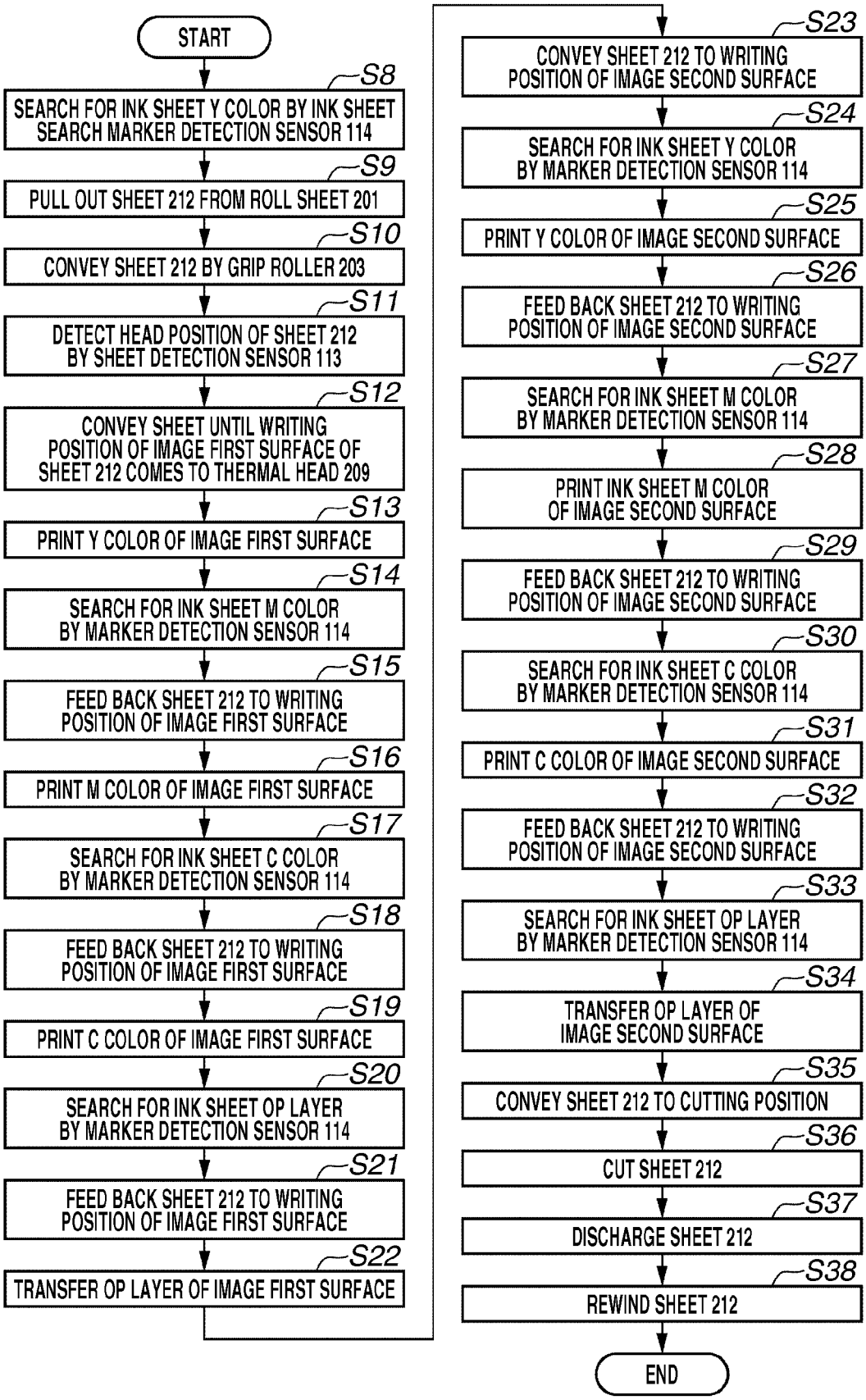
FIG. 5 is a flowchart illustrating a procedure of printing by the thermal transfer printer according to an exemplary embodiment.

Next, printing (recording control) executed by the thermal transfer printer according to the present exemplary embodiment is described. FIG. 5 is a flowchart illustrating a procedure of the printing executed by the thermal transfer printer according to the present exemplary embodiment.

Figure 10:
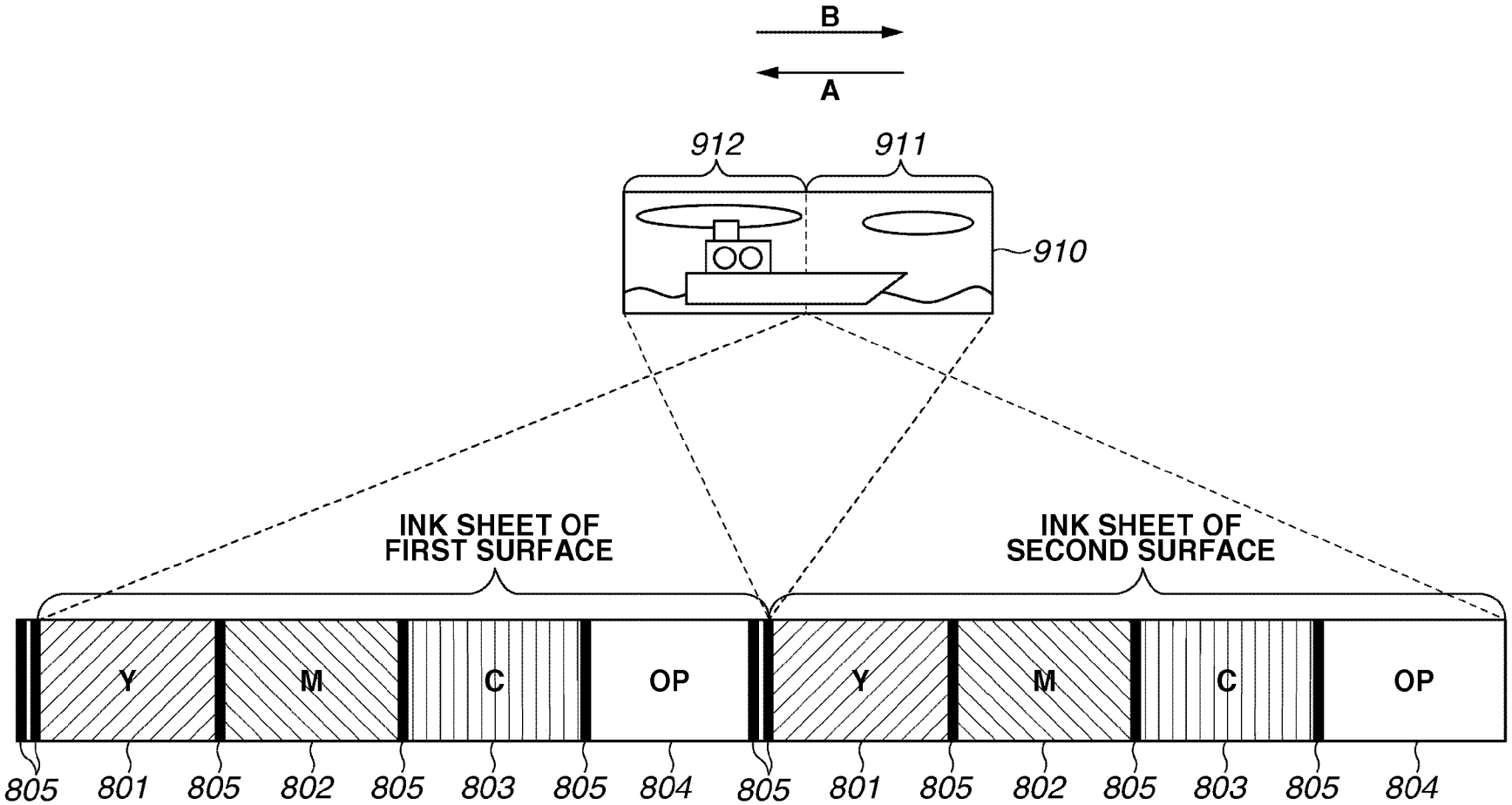
FIG. 10 illustrates a printing example of a panoramic image using an ink sheet.

The processing illustrated in the flowchart is in a panoramic size print mode that is a continuous print mode executable by the printer according to the present exemplary embodiment. In the panoramic print mode, as illustrated in FIG. 10, a panoramic image twice as long as that of one surface is printed by using two surfaces of the ink sheet 205.

Figure 6:
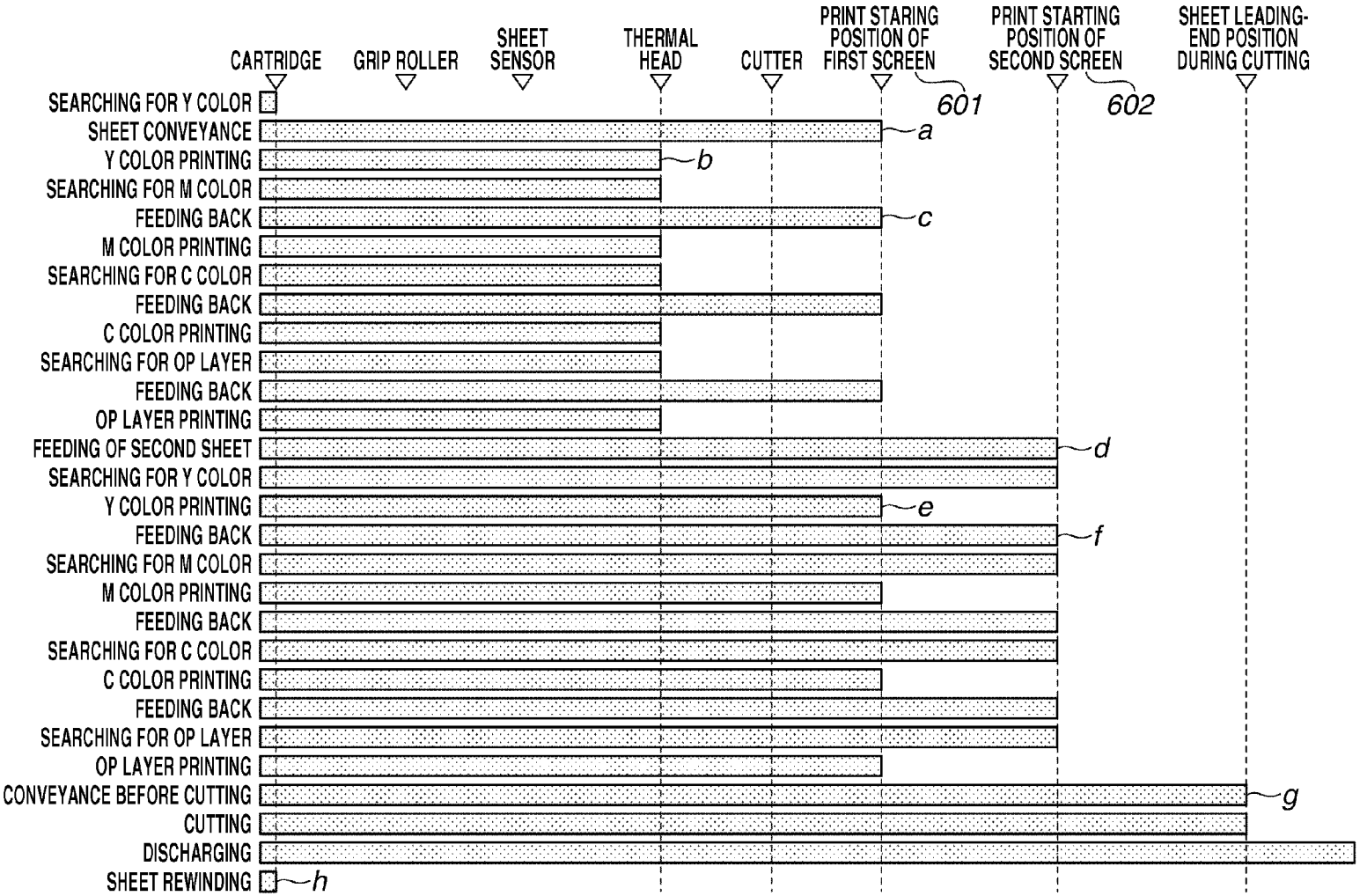
FIG. 6 illustrates a sheet leading-end position in each step in a panoramic print mode by the thermal transfer printer according to an exemplary embodiment.

FIG. 6 illustrates a leading end position of a sheet in each step in the panoramic print mode.

First, in step S8, the roll bobbin 208 of the ink sheet take-up side is taken up to search for the ink portion 801 of Y. In this case, the ink sheet 205 is taken up until the marker 805 of the ink portion 801 of Y (only marker of the ink portion 801 of Y can be identified by double lines) is detected by the marker detection sensor 114.

In step S9, through rotational driving of the feed roller 202, the sheet 212 is pulled out from the roll sheet 201 to be conveyed to the grip roller 203. Conveyance of the sheet 212 in step S10 and after is performed by rotating the grip roller 203 driving-controlled by a stepping motor (not illustrated).

In step S11, a leading end of the sheet 212 conveyed by rotating the grip roller 203 is detected by the sheet detection sensor 113. In step S12, the sheet 212 is conveyed by a predetermined number of steps to a printing start position 601 of a first screen of the panoramic image (state "a" illustrated in FIG. 6).

After the sheet 212 has been conveyed to the printing start position 601, the thermal head 209 that has stood by during the searching for the ink sheet 205 and the sheet conveyance is in a contacted state by pressure to the platen roller 204 to sandwich the sheet 212 and the ink sheet 205.

In step S13, the main controller 101 reads the image data from the memory card to generate image data, and stores the print data in the RAM 111.

The print data thus stored in the RAM 111 is read and transferred to the driver controller 121 of the thermal head 209, and the heating elements of the thermal head 209 are driven to generate heat based on a head control signal. Thus, the ink sheet 205 is heated according to the print data, and the dyes are sublimated/fixed to the sheet 212 in contact, thereby printing (transferring) an image of one line.

By printing an image of a predetermined line while conveying the sheet by rotating the grip roller 203, an image of Y is printed (state "b" illustrated in FIG. 6). In step S13, by rotating the grip roller 203 by a number of steps equal to a size of the image, the sheet 212 is conveyed in the arrow A direction illustrated in FIG. 2.

After the image of Y has been printed, the processing proceeds to step S14. The thermal head 209 is moved to a retracting position, thereby setting the sheet 212 and the ink sheet 205 to be freely movable.

As in the case of step S8, while taking up the roll bobbin 208 of the ink sheet take-up side, the marker 805 of the ink portion 802 of M is detected by the marker detection sensor 114 to search for the ink portion 802 of M. The processing then proceeds to step S15. The grip roller 203 is rotationally driven in a direction reverse to that during the printing, and the sheet 212 is conveyed in the arrow B direction until the printing start position 601 of the sheet 212 matches the positions of the heating elements of the thermal head 209 (state "c" illustrated in FIG. 6).

In step S16, to overlap the image portion printed by Y, as in the case of step S13, an image of M is printed by the ink portion 802 of M. Thereafter, similarly, according to a procedure of steps S17 to S22, C and OP portions are printed to overlap the image portion printed by Y.

After the OP portion 804 of the image of the first screen has been transferred, the processing proceeds to step S23. The thermal head 209 is moved to the retracting position to set the sheet 212 and the ink sheet 205 to be freely movable. Then, the grip roller 203 is rotated to convey the sheet 212 in the arrow B direction to a printing start position 602 of a second screen of the panoramic image (step d illustrated in FIG. 6).

In step S24, while taking up the roll bobbin 208 of the ink sheet take-up side, the marker 805 of the ink portion 801 of Y of the second surface is detected by the marker detection sensor 114 to search for the ink portion 801 of Y.

In step S25, as in the case of step S13, the image of Y is printed. In this case, as illustrated in FIG. 6, a printing end position of the second screen (state e illustrated in FIG. 6) is similar to the printing start position 601 of the first screen.

In step S26, the thermal head 209 is moved to the retracting position, and the grip roller 203 is rotationally driven in a direction reverse to that during the printing to convey the sheet 212 in the arrow B direction to a printing start position 602 of the second screen of the sheet 212 (step f illustrated in FIG. 6). In step S27, while taking up the roll bobbin 208 of the ink sheet take-up side, the marker 805 of the ink portion 802 of M of the second surface is detected by the marker detection sensor 114 to search for the ink portion 802 of M.

In step S28, to overlap the image portion of the second screen printed by Y, as in the case of step 25, an image of M is printed by the ink portion 802 of M. Thereafter, similarly, according to a procedure of steps S29 to S34, C and OP portions are printed to overlap the image portion printed by Y.

Through the processing described above, the image of the second screen of the panoramic image is printed, and a panoramic image having a length equal to the two surfaces of the ink sheet is printed on the sheet 212.

After the panoramic image has been printed, the processing proceeds to step S35. The thermal head 209 is moved to the retracting position to rotationally drive the grip roller 203 in a direction reverse to that during the printing (arrow B direction illustrated in FIG. 2). The sheet 212 is conveyed in the arrow B direction until a cutting position of the sheet 212 reaches a position of the cutter 211 (step "g" illustrated in FIG. 6). In step S36, the sheet 212 is cut by the cutter 211.

Then, the processing proceeds to step S37. The sheet cut in step S36 is held by the discharge roller 207, and conveyed in a discharge direction by a driving force of the motor. The printed sheet 212 is then discharged from the printer.

Lastly, in step S38, the remaining sheet 212 is rewound by rotational driving of the grip roller 203 and the feed roller 202 (step "h" illustrated in FIG. 6). Through the processing described above, the printing of the panoramic image is ended. When a normal image other tan the panoramic image is printed, processing similar to that of the panoramic image from step S8 to step S22 is performed, and then the processing proceeds to step S35. In step S35 and after, processing similar to that of the panoramic image is performed.

Figure 7:
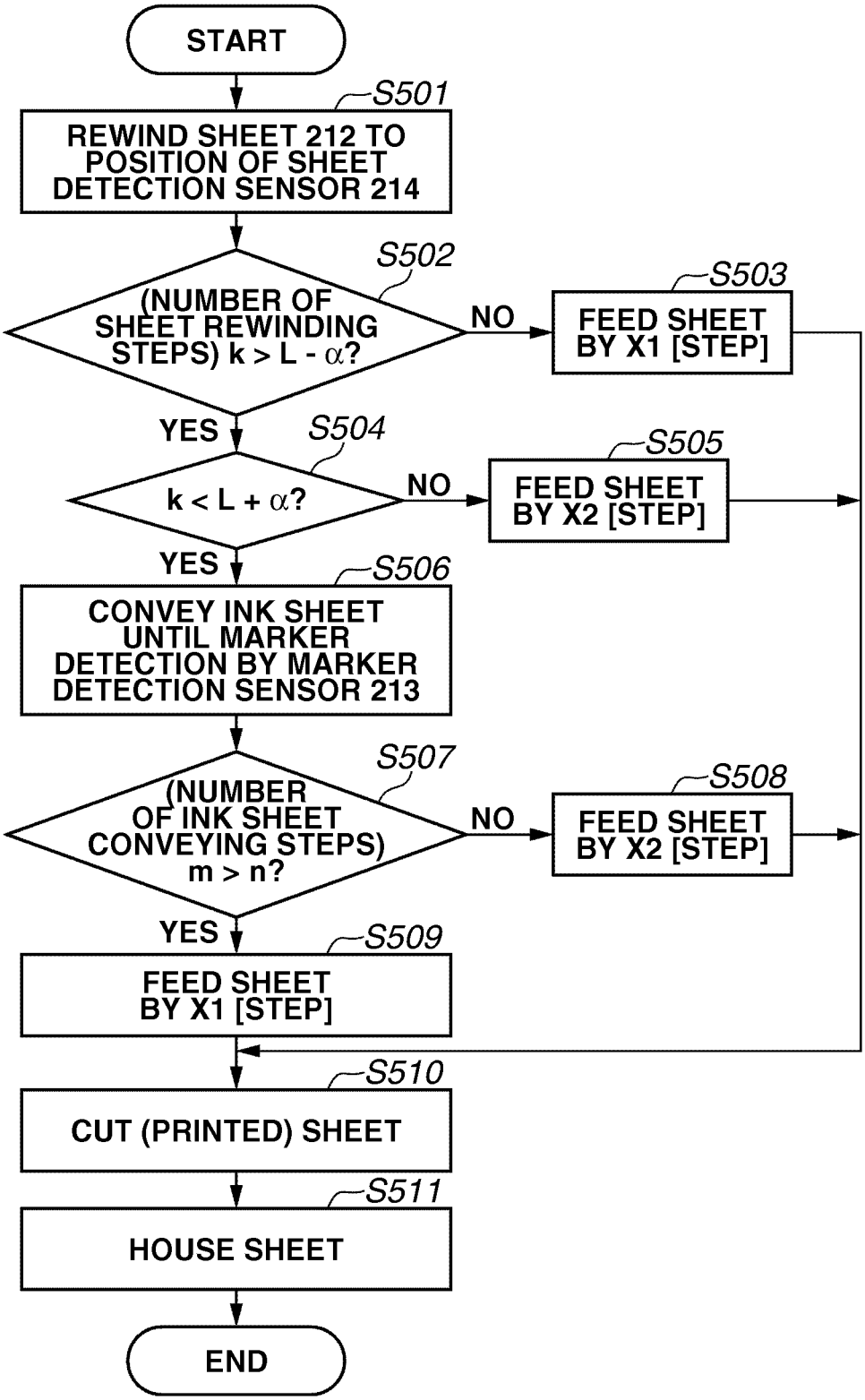
FIG. 7 is a flowchart illustrating a procedure of remaining sheet detection by the thermal transfer printer according to an exemplary embodiment.

The remaining sheet detection (step S5 illustrated in FIG. 3) by the thermal transfer printer according to the exemplary embodiment is described below. FIG. 7 is a flowchart illustrating a procedure of the remaining sheet detection by the thermal transfer printer according to the present exemplary embodiment.

As illustrated in FIG. 6, the sheet leading-end position during printing of the first screen is similar to or on the upstream side of the printing start position 601 of the first screen, and the sheet leading-end position during printing of the second screen is similar to or on the downstream side of the printing start position 601 of the first screen.

Based on this understanding, first, in step S501, the grip roller 203 is rotationally driven by an instruction from the main controller 101 to rewind the sheet 212 in the engine to a position of the sheet detection sensor 113. The number of driving steps for the stepping motor from a driving start to rewinding completion in this case is counted as a leading-end detection conveyance amount by the main controller 101. This is set as, for example, k[step]. The counted value is temporarily stored in the RAM 111. In this case, the ink sheet 205 is not conveyed.

The main controller 101 then compares the k[step] with L[step] and α[step] stored in the ROM 110. The L[step] corresponds to the number of driving steps of the stepping motor necessary for rewinding the sheet to the printing start position 601 of the first screen of the panoramic image illustrated in FIG. 6.

In other words, the L[step] corresponds to the number of driving steps of the stepping motor necessary for rewinding the sheet from a position farthest from the sheet detection sensor 113 during the printing of the first screen to the position of the sheet detection sensor 113. The α[step] corresponds to a small number of steps assuming an error of feeding accuracy of the stepping motor.

Specifically, first, in step S502, k[step] is compared with (L−α)[step] that is a first threshold value. In the case of k[step]≦(L−α)[step] (when a leading-end detection conveyance amount k is equal to or less than the first threshold value) (NO in step S502), a remaining sheet is determined to be in the middle of printing of the first screen, and the processing proceeds to step S503. In step S503, the grip roller 203 is rotationally driven to convey the sheet 212 in the arrow B direction by a discharge amount X1[step] stored in the ROM 110.

The discharge amount X1[step] corresponds to the number of driving steps of the stepping motor necessary for conveying the sheet 212 in the arrow B direction until a termination position of a print area of the first screen of the panoramic image becomes a cutting position by the cutter 211. In other words, in step S503, the sheet 212 is conveyed in the arrow B direction by a distance obtained by adding a sub-scanning length of the first screen of the panoramic image to a distance from the sheet detection sensor 113 to the cutter 211.

On the other hand, in the case of k[step]>(L−α)[step] (YES in step S502), a remaining sheet cannot be determined to be in the middle of printing of the first screen, and hence the processing proceeds to step S504. In step S504, k[step] is compared with (L+α)[step] that is a second threshold value. In the case of k[step]≧(L+α)[step] (when leading-end detection conveyance amount k is equal to or more than the second threshold value) (NO in step S504), the remaining sheet is determined to be in the middle of printing of the second screen, and the processing proceeds to step S505. In step S505, the grip roller 203 is rotationally driven to convey the sheet 212 in the arrow B direction by a discharge amount X2[step].

The discharge amount X2[step] corresponds to the number of driving steps of the stepping motor necessary for conveying the sheet 212 in the arrow B direction until a termination position of a print area of the second screen of the panoramic image becomes a cutting position by the cutter 211. In other words, in step S505, the sheet 212 is conveyed in the arrow B direction by a distance obtained by adding a sub-scanning length of the panoramic image to the distance from the sheet detection sensor 113 to the cutter 211.

On the other hand, in the case of k[step]<(L+α)[step] (YES in step S504), the remaining sheet can be determined to be neither in the middle of printing of the first screen nor in the middle of printing of the second screen, and hence the processing proceeds to step S506.

In the case of (L−α)[step]<k[step]<(L+α)[step], the remaining sheet is limited to before or after the printing start position 601 of the fist screen illustrated in FIG. 6, in other words, the printing start time by one of the ink portions 801 to 804 of the first screen or the printing end time by one of the ink portions 801 to 804 of the second screen.

In step S506 and after, determination is executed by utilizing a large difference in search position detection conveyance amount to a search position of the ink sheet 205 between the printing start time and the printing end time. In other words, when the remaining sheet is in the middle of printing of the first screen, it is at the printing start time, and hence it is relatively long until a next search position. On the other hand, when the remaining sheet is in the middle of printing of the second screen, it is at the printing end time, and hence it is relatively short to a next search position.

Specifically, first, in step S506, the roll bobbin 208 of the ink sheet take-up side is taken up based on an instruction from the main controller 101 to detect the marker 805 by the marker detection sensor 114. The number of driving steps for the stepping motor from a driving start to marker detection is counted as a search position detection conveyance amount by the main controller 101. This is set, for example, as m[step]. The counted value is temporarily stored in the RAM 111.

In step S507, the main controller 101 compares the m[step] with n[step] that is a third threshold value stored in the ROM 110. The n[step] corresponds to the number of steps larger than that when the ink sheet 205 is conveyed to the marker 805 of a next color after a normal end of printing, and smaller than that when the ink sheet 205 is conveyed only by one ink portion (when conveyed from the marker 805 to the marker 805 of the next color).

In the case of m[step]≦n[step] (when a search position detection conveyance amount m is equal to or less than the third threshold value) (NO in step S507), the processing proceeds to step S508. In this case, the remaining sheet is determined to be in the middle of printing of the second screen. Hence, as in the case of step S503, the grip roller 203 is rotationally driven to convey the sheet 212 in the arrow B direction by a discharge amount X2[step].

In the case of m[step]>n[step] (when the search position detection conveyance amount m is larger than the third threshold value) (YES in step S507), the processing proceeds to step S509. In this case, the remaining sheet is determined to be in the middle of printing of the first screen. Hence, as in the case of step S505, the grip roller 203 is rotationally driven to convey the sheet 212 in the arrow B direction by a discharge amount X1[step].

Figure 8:
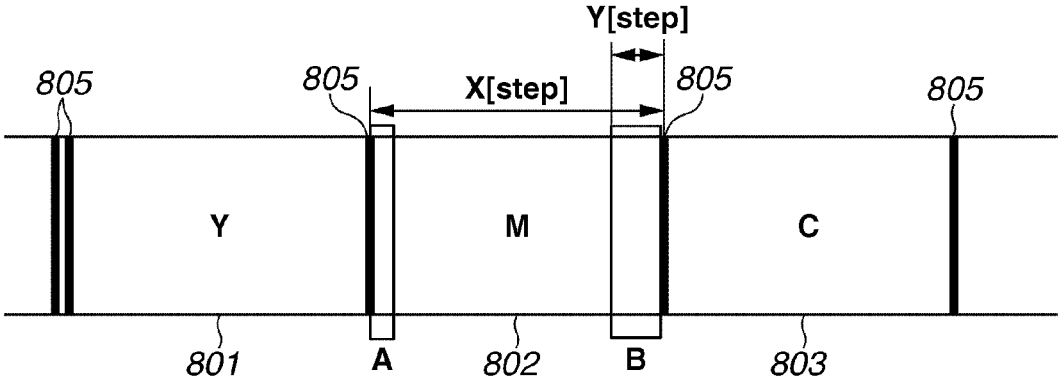
FIG. 8 illustrates n[step] that is a threshold value.

Referring to FIG. 8, the n[step] that is a threshold value is described in detail. The number of steps X is needed when the ink sheet 205 is conveyed only by one ink portion (when conveyed from the marker 805 to the marker 805 of the next color). The number of steps Y is needed when the ink sheet 205 is conveyed to the marker 805 of the next color after the normal end of printing.

In step S507, a stop position of the sheet 212 is the printing start position of the image of the first screen or the printing end position of the second screen. Thus, when the number of steps m needed when the sheet is conveyed to the next marker 805 is smaller than Y (in the middle of printing around a range B), the stop position should be the printing end position of the second screen, and hence the sheet is conveyed by a discharge amount X2[step] to be cut by a two-screen amount.

When the number of steps m is close to X (in the middle of printing around a range A), the stop position should be the printing start position of the image of the first screen, and hence the sheet is conveyed by a discharge amount X1[step] to be cut by a two-screen amount.

For setting the threshold value n[step], any value can be employed as long as it is the number of steps when the sheet is conveyed from one of points between the area A and the area B to a next marker. In other words, the value of n is Y or more to X or less. More precisely, the value of n is represented by the following expression:

$$Y<Y+\beta<n<X-\omega<X$$

In the expression, β is the number of steps due to a conveyance error, and ω is a value including the number of steps when the sheet is conveyed from the marker 805 to the printing start position and the number of steps due to a conveyance error.

In the case of a printer that can perform printing by a plurality of sheet sizes, a value of Y varies from one sheet size to another, and hence n is to be set to a value not affected by any sheet size. In other words, n is set to a value larger than the number of steps of one of the plurality of sheet sizes, which is largest in step when the ink sheet 205 is conveyed to the marker 805 of a next color after a printing end.

After completion of any one of steps S503, S505, S508, and S509, the processing proceeds to step S510. In step S510, the sheet 212 is cut by the cutter 211. By rotating the discharge roller 207, the printed sheet 212 is discharged from the printer. Lastly, in step S511, remaining sheet 212 is rewound by rotationally driving the grip roller 203 and the feed roller 202 to be housed in the sheet cartridge.

Through the processing described above, the remaining sheet detection processing is ended. The remaining sheet detection processing allows suppression of sheet wastes and prevention of reprinting on the printed sheet during next printing.

In the present exemplary embodiment, in the remaining sheet detection processing, when the remaining sheet cannot be determined based on the sheet conveyance amount, the remaining sheet is determined based on the conveyance amount of the ink sheet until the detection of the marker 805. However, this arrangement is in no way limitative.

For example, a success/failure of detection by the marker detection sensor 114 when the ink sheet 205 is conveyed by a predetermined amount n[step]. In other words, when the marker detection sensor 114 detects a marker 805 during conveyance of the ink sheet 205 by n[step], the sheet 212 is conveyed in the arrow B direction by a discharge amount X2[step].

On the other hand, when no marker 805 is detected, the sheet 212 is conveyed in the arrow B direction by a discharge amount X1[step]. Processing thereafter can be similar to that described above.

The present exemplary embodiment has been directed to the case where the printing direction and the sheet rewinding direction are identical (arrow A direction illustrated in FIG. 2). However, the printing direction can be the same direction as the sheet pulling-out direction. In this case, the ink sheet 205 can be searched for in a state where a sheet leading end is at the printing start position in the case of the first screen and at the printing end position in the case of the second screen.

In the present exemplary embodiment, the position of the cutter 211 is on the downstream side of the thermal head 209. Hence, during normal printing, a sheet leading-end position before cutting after printing is on the downstream side of a sheet leading-end position at the start time of printing. Only in this case, in the remaining sheet detection, accurate remaining sheet processing becomes difficult. However, since time period of such a state is short during printing of one sheet, a probability of sheet wastes during the remaining sheet detection is small.

An example to solve the problem is a configuration where the cutter 211 is located on the upstream side of the thermal head 209, and the grip roller is independently driven during the remaining sheet detection. With this configuration, only remaining roll sheet is rewound while a print product after cutting is not rewound. Thus, appropriate remaining sheet detection can be performed in any situation.

The embodiments are not limited to the panoramic size, and can be applied when printing is performed so that a plurality of images are printed adjacently to each other. For example, an embodiment can be applied when two surfaces of L-sheet ink having a main scanning direction set as a longitudinal direction are used, and printing is performed on a 2 L sheet having a sub-scanning direction set as a longitudinal direction by locating two screens adjacent to each other. The embodiment is in no way limitative of that specified in a scope of claims. All combinations of features of the present exemplary embodiment are not necessarily essential to solution.

Embodiments are achieved by executing the following processing. That is, software (program) for achieving the functions of the exemplary embodiments is supplied to a system or an apparatus via a network or various storage media, and a computer (or central processing unit (CPU) or microprocessing unit (MPU)) of the system or the apparatus reads the program to execute it.

Aspects can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium). In such a case, the system or apparatus, and the recording medium where the program is stored, are included as being within the scope of the embodiments. In an example, a computer-readable medium may store a program that causes a printer to perform a method described herein. In another example, a central processing unit (CPU) may be configured to control at least one unit utilized in a method or apparatus described herein.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-169511 filed Jul. 28, 2010, which is hereby incorporated by reference herein in its entirety.

What is claimed is:

1. A printer to execute a continuous print mode by using a plurality of sets of ink portions, wherein each set of ink portions has a plurality of ink portions of an ink sheet in which the plurality of ink portions are sequentially arranged in a conveyance direction, and to print a plurality of screens adjacent to each other, the printer comprising:

a sheet conveyance unit configured to convey a sheet;

a sheet detection unit configured to detect a leading end of a sheet;

an ink sheet conveyance unit configured to convey the ink sheet;

a search position detection unit configured to detect a search position of each ink portion of the ink sheet; and a control unit configured to convey, in a case where power for the printer is turned ON, a sheet that has been pulled out from a sheet housing unit in a direction for returning the sheet into the housing unit using the sheet conveyance unit, calculate a leading-end detection conveyance amount until a leading end of the sheet is detected by the sheet detection unit, and determine a discharge amount of the sheet based on the leading-end detection conveyance amount.

2. The printer according to claim 1, further comprising a cutting unit configured to cut the sheet, wherein, based on the discharge amount determined by the control unit, the sheet is conveyed by the sheet conveyance unit, and cut by the cutting unit.

3. The printer according to claim 1, wherein, in a case where the leading-end detection conveyance amount is within a predetermined range, the control unit conveys the ink sheet using the ink sheet conveyance unit, calculates a search position detection conveyance amount until the search position is detected by the search position detection unit, and determines the discharge amount of the sheet based on the search position detection conveyance amount.

4. The printer according to claim 1, wherein, in a case where a conveyance amount until the leading end of the sheet is detected is within a predetermined range, the control unit conveys the ink sheet by a predetermined amount using the ink sheet conveyance unit, determines a success or a failure of the search position detection by the search position detection unit, and determines the discharge amount of the sheet based on a result of the success or a failure determination.

5. The printer according to claim 1, wherein the continuous print mode is a mode for using two sets of ink portions, and printing two screens adjacent to each other to perform printing, and wherein the control unit further is configured to compare the leading-end detection conveyance amount with a first threshold value and a second threshold value that is larger than the first threshold value, wherein in a case where the control unit judges the printer to be in a middle of printing a first screen, the control unit determines the discharge amount of the sheet in a case where the leading-end detection conveyance amount is equal to or less than the first threshold value, and, in a case where the control unit judges the printer to be in a middle of printing a second screen, the control unit determines the discharge amount of the sheet in a case where the leading-end detection conveyance amount is equal to or more than the second threshold value.

6. The printer according to claim 5, wherein, in a case where the leading-end detection conveyance amount is larger than the first threshold value and smaller than the second threshold value, the control unit conveys the ink sheet using the ink sheet conveyance unit, calculates the search position detection conveyance amount until the search position is detected by the search position detection unit, compares the search position detection conveyance amount with a third threshold value, judges that the printer is in the middle of printing of the first screen, and, in a case where the search position detection conveyance amount is larger than the third threshold value, the control unit determines the discharge amount of the sheet, and judges the printer to be in the middle of printing of the second screen and, in a case where the search position detection conveyance amount is equal to or less than the third threshold value, determines the discharge amount of the sheet.

7. The printer according to claim 5, wherein, in a case where the leading-end detection conveyance amount is larger than the first threshold value and smaller than the second threshold value, the control unit conveys the ink sheet by a predetermined amount using the ink sheet conveyance unit, determines a success or a failure of the search position detection by the search position detection unit, and judges the printer to be in the middle of printing of the first screen and, in a case where no search position is detected, determines the discharge amount of the sheet, and, in a case where the search position is detected, judges the printer to be in the middle of printing of the second screen, and determines the discharge amount of the sheet.

8. A method for controlling a printer to execute a continuous print mode by using a plurality of sets of ink portions, wherein each set of ink portions has a plurality of ink portions of an ink sheet in which the plurality of ink portions are sequentially arranged in a conveyance direction, and to print a plurality of screens adjacent to each other, wherein the printer includes:

a sheet conveyance unit configured to convey a sheet, a sheet detection unit configured to detect a leading end of a sheet, an ink sheet conveyance unit configured to convey the ink sheet, a search position detection unit configured to detect a search position of each ink portion of the ink sheet, the method comprising:

conveying, in a case where power for the printer is turned ON, a sheet that has been pulled out from a sheet housing unit in a direction for returning the sheet into the housing unit using the sheet conveyance unit;

calculating a leading-end detection conveyance amount until a leading end of the sheet is detected by the sheet detection unit, and determining a discharge amount of the sheet based on the leading-end detection conveyance amount.

9. A non-transitory computer readable medium storing computer-executable instructions for controlling a printer to execute a continuous print mode by using a plurality of sets of ink portions, wherein each set of ink portions has a plurality of ink portions of an ink sheet in which the plurality of ink portions are sequentially arranged in a conveyance direction, and to print a plurality of screens adjacent to each other to perform printing, wherein the printer includes:

a sheet conveyance unit configured to convey a sheet, a sheet detection unit configured to detect a leading end of a sheet, an ink sheet conveyance unit configured to convey the ink sheet, a search position detection unit configured to detect a search position of each ink portion of the ink sheet, the program causing a computer to execute:

conveying, in a case where power for the printer is turned ON, a sheet that has been pulled out from a sheet housing unit in a direction for returning the sheet into the housing unit using the sheet conveyance unit;

calculating a leading-end detection conveyance amount until a leading end of the sheet is detected by the sheet detection unit, and determining a discharge amount of the sheet based on the leading-end detection conveyance amount.

* * * * *